United States Patent [19]

Malamas et al.

[11] Patent Number: 4,991,513

[45] Date of Patent: Feb. 12, 1991

[54] CARRIER PROJECTILE WITH SAFETY VENTS

[75] Inventors: James Malamas, Fredericksburg, Va.; Harvey M. Day, Waldorf, Md.

[73] Assignee: The United States of America as represented by the Secretary of the Navy, Washington, D.C.

[21] Appl. No.: 491,792

[22] Filed: Mar. 12, 1990

[51] Int. Cl.[5] ..... F42B 12/00; F42B 39/00

[52] U.S. Cl. ..... 102/481; 102/293; 102/357; 102/473; 102/489

[58] Field of Search ..... 102/340, 342, 351, 357, 102/293, 473, 481, 489, 499, 500

[56] References Cited

U.S. PATENT DOCUMENTS

| | | | |
|---|---|---|---|
| 1,309,982 | 7/1919 | Darling | 102/473 |
| 3,054,258 | 9/1962 | Marti, Jr. . | |
| 3,786,760 | 1/1974 | Feldmann | 102/526 |
| 4,004,516 | 1/1977 | Johnson et al. | 102/481 |
| 4,114,369 | 9/1978 | Crowley . | |
| 4,232,607 | 11/1980 | Benson | 102/489 |
| 4,411,199 | 10/1983 | Yates et al. | 102/481 |
| 4,557,198 | 12/1985 | Hickey | 102/481 |
| 4,714,020 | 12/1987 | Hertsgaard et al. | 102/481 |
| 4,771,696 | 9/1988 | Smolnik | 102/473 |

*Primary Examiner*—Harold J. Tudor

*Attorney, Agent, or Firm*—John D. Lewis; Kenneth E. Walden

[57] ABSTRACT

The invention is a carrier projectile 10 having a safety venting system which prevents expulsion of the projectile cargo during accidental or inadvertent initiation of the expulsion charge 21. The venting system comprises a collar which closes vent holes when the projectile is fired. The normal activation sequence of the carrier projectile is firing to a predetermined range or time, activation of the expulsion charge thereby bursting open the carrier shell, and dispensing of the cargo. The venting system incorporated into the present invention precludes bursting of the carrier shell, even if the activation of the expulsion charge occurs, unless the vents have been closed by the actual firing of the projectile. The venting system provides a safety feature in the event that the projectile is subjected to fire or other thermal stress and in the event of a hot gun misfire the collar is operated by either angular acceleration or longitudinal acceleration.

5 Claims, 2 Drawing Sheets

CARRIER PROJECTILE WITH SAFETY VENTS

ORIGIN OF THE INVENTION

The invention described herein was made in the performance of official duties by employees of the Department of the Navy and may be manufactured, used, licensed by and for the Government for any governmental purposes without payment of any royalties thereon.

FIELD OF THE INVENTION

This invention relates generally to spin stabilized cargo carrying projectiles with a cargo expelling charge and more specifically to cargo carrying projectiles having a venting system for preventing the premature expulsion of projectile cargo.

BACKGROUND OF THE INVENTION

Cargo or carrier projectiles typically include projectile-shaped bodies, cargo, and a time fuzed ejection charge to expel the cargo during projectile flight. When exposed to flames, heat or other thermal stimuli, the most vulnerable element of this system, i.e. the expulsion charge, may reach its cook-off temperature and expel a large quantity of hazardous material from the projectile. Safety features are necessary to reduce the hazards of an accidental cook-off. Some older methods employed to protect ordnance from the effects of heat include a thermal insulation coating, used primarily on aircraft-delivered bombs, and low-temperature melt-out plugs, used primarily on certain U.S. Army projectiles. Thermal coatings are acceptable for bombs, but are not suitable for Naval guns because the coatings are susceptible to handling damage and may cause disturbances to projectile aerodynamics. Melt-out plugs are also unsuitable because they must be replaced with live fuzes just prior to firing. These replacement procedures are prohibited aboard U.S. Navy ships for safety reasons. Neither coatings nor melt-out plugs provide any significant protection for a misfire in a hot gun breech.

SUMMARY OF THE INVENTION

The invention is a carrier projectile having a safety venting feature which prevents any cargo expulsion until after the projectile has been fired. The cargo projectile has vent holes in the nose cone of the cargo expulsion system which are blocked by a movable collar which is displaced by centrifugal force to a closed position upon firing.

An object of this invention is to improve the safety response of a cargo projectile when subjected to inadvertent thermal stimuli anytime during its ammunition life cycle such as handling, magazine storage, transportation, loading, etc. aboard combat ships, transport vessels, or at shore facilities. A further object of the invention is to enhance the safety of cargo projectiles by providing a degree of protection against a hot gun misfire.

BRIEF DESCRIPTION OF THE DRAWINGS

These and other features, objects and advantages of the present invention will be readily understood from the following detailed description when read in view of the appended drawings wherein.

DETAILED DESCRIPTION OF THE INVENTION

For illustrative purposes, the invention will be described as in relation to the MK 146 16-inch ICM spin stabilized projectile.

Figure 1:
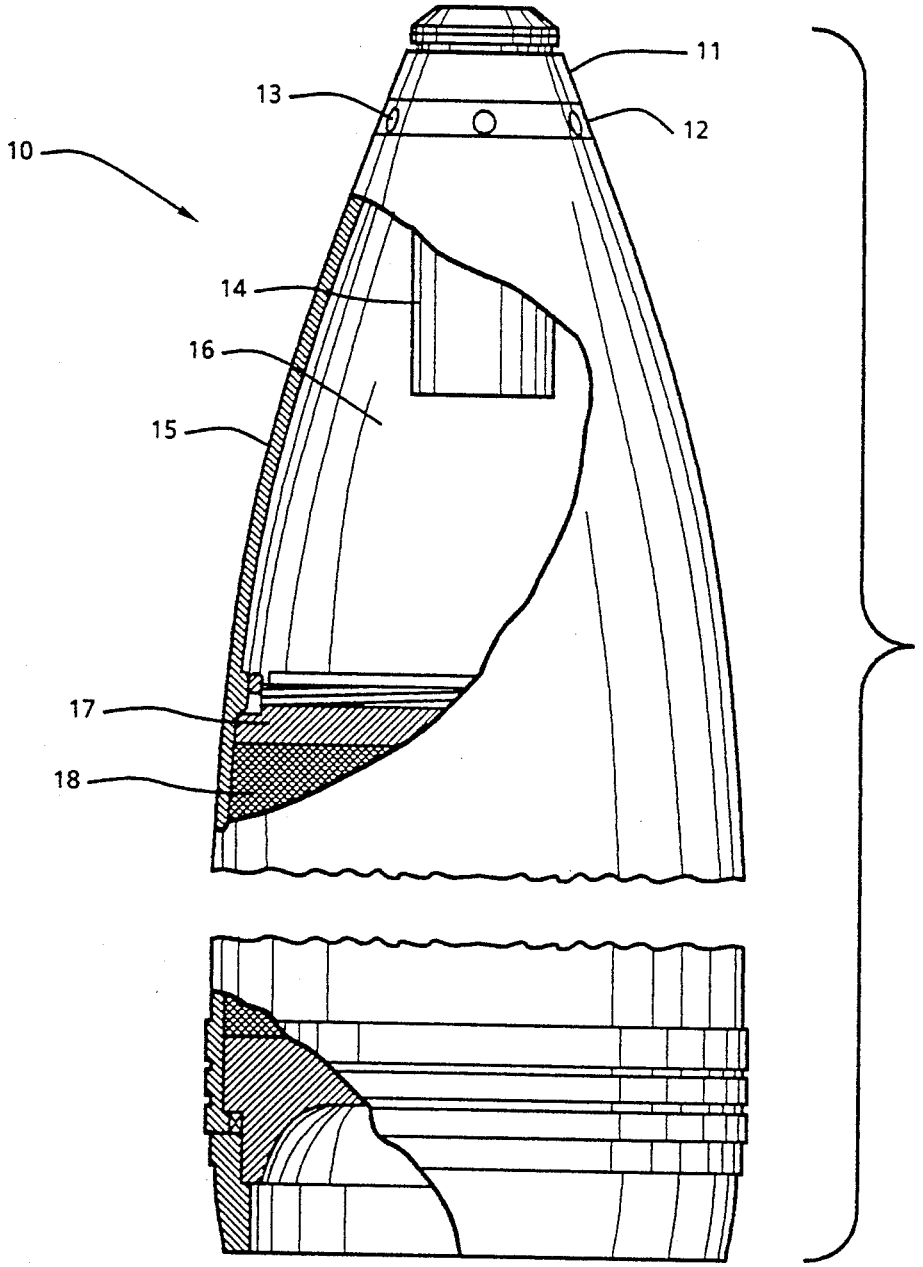
FIG. 1 is a cutaway side view of a spin stabilized cargo projectile.

Referring now to FIG. 1, a cutaway side view of the cargo projectile, depicted generally by the numeral 10, illustrates the relationship of the various components of the apparatus. The projectile comprises a nose cone 11, a cylindrical body 15, an expulsion charge assembly 14, a pusher plate 17, and a cargo 18. The expulsion charge is activated at predetermined conditions to cause the projectile to release its cargo 18. The cargo may consist of a variety of items including but not limited to propaganda leaflets, bomblet ammunitions and chemical agents. A plurality of radial vent holes 13 are disposed in a circular vent collar 12 which is attached to a nose assembly 11. The vent holes 13 may be opened or closed by the rotation of the circular vent collar 12. The nose assembly 11 also supports the expulsion charge assembly 14 and is attached to the projectile body 15 which also defines the expulsion chamber 16. A pusher plate 17 pushes the cargo 18 from the projectile when the expulsion charge 14 is activated.

Figure 2:
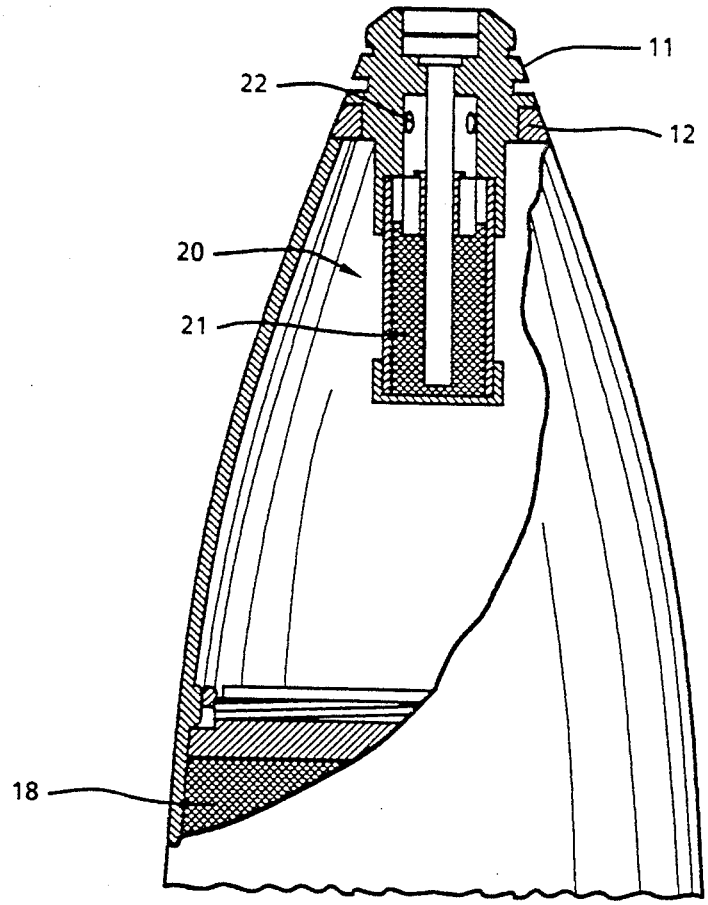
FIG. 2 is a cutaway cross-sectional side view of a spin stabilized cargo projectile with a rotationally closing vent collar.

Referring now to FIG. 2 in which the expulsion charge assembly is generally depicted by the numeral 20. A plurality of internal radial vent holes 22 disposed in the nose assembly 11 of the projectile can be selectively opened or closed by the rotation of a circular encompassing ring or circular vent collar 12 with a plurality of radial vent holes disposed around its periphery. When the holes in the nose 11 and in the collar 12 are coincident, as in the storage configuration, any burning reaction of the expelling charge 21 will fail to adequately pressurize the forward portion of the projectile and expulsion of the cargo 18 will not occur.

Figure 3:
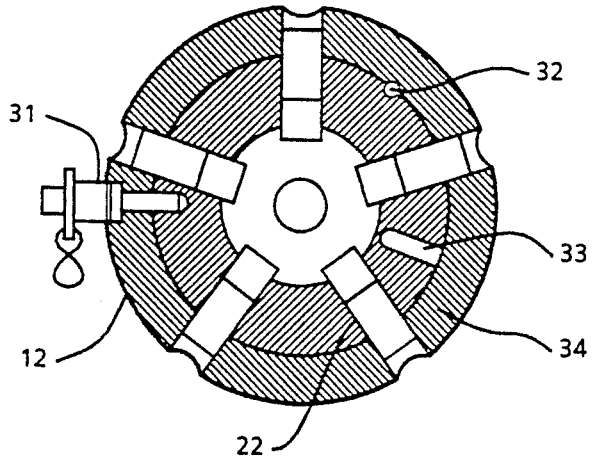
FIG. 3 is a cross-sectional view through the rotationally closing vent collar of the nose assembly of a spin stabilized cargo projectile.

Refer now to FIG. 3. Immediately prior to loading the projectile into the gun breech, a safety pin 31 in the circular vent collar 12 is withdrawn allowing it free angular movement for obstructing internal radial vent holes 22.

Upon gunfiring, the angular acceleration imparted to the entire projectile from rifling in the gun barrel reaches a maximum of 21,850 radians per second per second. Due to the inertia of the venting collar 12, a maximum torque of approximately 155 foot-pounds causes differential rotation of the collar 12 relative to the nose 11 thereby blocking the internal radial vent holes 22. The rotation of the circular vent collar 12 is limited to a maximum of 20 degrees by two positive stops for redundant reliability. An eccentric cam and ball arrangement 32 serves to restrict rotation with friction, while a spring loaded ball 33 simultaneously snaps into a detent 34 to prevent any rebounding of the circular vent collar 12. When the internal radial vent holes 22 are blocked the projectile is in the armed position and the expulsion charge system can pressurize when activated, expelling the cargo 18 as intended.

Changes and modifications varied to fit particular operating requirements and environments will be readily apparent to those skilled in the art, the invention is not to be considered limited to the embodiments chosen for the purpose of illustration, but includes all changes and modifications which do not constitute a departure from the true spirit and scope of this invention as delineated in the following claims and equivalents thereto.

Having thus described our invention we claim:

1. A carrier projectile system comprising:

a. cylindrically shaped housing having a longitudinal spin axis and a coaxial housing cavity;

b. an expulsion charge and fuze assembly disposed in the forward portion of said housing cavity for expelling cargo members;

c. a nose assembly attached to the forward end of said housing for supporting said expulsion charge and fuze assembly and having a plurality of vent holes disposed radially in the nose assembly;

d. a venting collar having a plurality of vent holes corresponding to the vent holes in said nose assembly rotatably attached to said nose assembly whereby spin of the carrier projectile rotates said venting collar, offsetting the vent holes in said collar from the vent holes in said nose assembly; and e. a safety pin for locking the vent collar in an open position.

2. A carrier projectile system comprising a carrier projectile as in claim 1 wherein said venting collar comprises a circular encompassing ring which is differentially rotated in respect to said nose assembly by centrifugal force when the projectile is shot thereby blocking the vent holes disposed in said nose assembly.

3. A carrier projectile system comprising:

a. a carrier projectile suitable for carrying cargo;

b. means for expelling cargo members from said carrier projectile; and c. means for venting said means for expelling comprising a rotating collar containing a plurality of vent holes which align with holes in said carrier projectile whereby said means for expelling is vented until the carrier projectile is fired whereupon centrifugal force rotates said rotating collar closing said means for venting.

4. A carrier projectile system as in claim 3 wherein said carrier projectile further comprises a spin stabilized projectile.

5. A carrier projectile system as in claim 3 further defined by a locking pin whereby said means for venting can be locked open in the vented position.

* * * * *